United States Patent [19]

Herr

[11] Patent Number: 4,579,238

[45] Date of Patent: Apr. 1, 1986

[54] ONE-PIECE MOISTURE-TIGHT SAFETY CLOSURE AND CONTAINER

[75] Inventor: James E. Herr, East Petersburg, Pa.

[73] Assignee: Kerr Glass Manufacturing Corporation, Los Angeles, Calif.

[21] Appl. No.: 726,044

[22] Filed: Apr. 23, 1985

[51] Int. Cl.[4] ..... B65D 55/02

[52] U.S. Cl. ..... 215/211; 215/222

[58] Field of Search ..... 215/211, 222, DIG. 1

[56] References Cited

U.S. PATENT DOCUMENTS

| | | | |
|---|---|---|---|
| 3,917,096 | 11/1975 | Hedgewick | 215/211 |
| 4,091,948 | 5/1978 | Northup | 215/222 |
| 4,444,327 | 4/1984 | Hedgewick | 215/222 |

*Primary Examiner*—G. T. Hall

*Attorney, Agent, or Firm*—Fitch, Even, Tabin & Flannery

[57] ABSTRACT

A child-resistent, moisture-tight safety closure having an end wall with an annular depending skirt, the skirt having a plurality of locking lugs disposed on the inside thereof. The locking lugs cooperate with retaining notches adjacent to the open mouth of an associated container to releasably retain the closure on the container. A sealing plug integral with the end wall of the closure and concentric with the annular skirt effects a moisture-tight seal with the inner wall of the container. A plurality of resilient members are integral with the interior of the closure at the junction of the top wall and the skirt, the resilient members extending downwardly and inwardly so as to engage the end surface of the container opening. The compression of the resilient members serves to bias the locking lugs on the closure into locking relationship with the retaining notches on the container with a force sufficient to ensure the child-resistant characteristics of the closure.

7 Claims, 5 Drawing Figures

ONE-PIECE MOISTURE-TIGHT SAFETY CLOSURE AND CONTAINER

BACKGROUND

The present invention relates generally to safety closures and containers, and more particularly to a one-piece, child-resistant closure and its associated container, the closure including means for effecting a moisture-tight sealing relation between the container and the closure.

Safety closures and containers are in wide use in which the closures have a plurality of locking lugs formed thereon which are cooperative with retaining grooves formed on the container so as to require simultaneous downward and rotational movement of the closure to effect locking engagement of the lugs with the retaining recesses. Such closures are often provided with means therein to bias the locking lugs into locking relation with the retaining recesses on the container with a force sufficient to prevent young children from effecting the proper movement of the closure cap required for removing the closure from the container. See, for example, U.S. Pat. No. 3,344,942 which discloses an annular bell-shaped web which is flexed against the rim of the container to provide the biasing force. The annular web does not flex as readily as desired and provides an uncertain seal. In other closures, the biasing means may also function to attempt to effect a seal with the container. See, e.g., Akers U.S. Pat. No. Re. 30,625. However, the ability of this seal and spring to function satisfactorily after repetitive openings and closings is questionable.

The present invention is particularly directed to medicine vials which are used to package prescription medicine and, consequently, must meet certain standards concerning moisture permeability. Federal standards on moisture vapor permeability require a closure to effect a seal that permits less than 100 milligrams of water vapor per day per liter of volume to enter the sealed container. In order to effect such a seal, it is necessary that the sealing member on the closure be sufficiently pliable to conform to any irregularities in the container surface that the seal engages. However, problems have arisen in one-piece closures where the resilient seal is also used to provide the biasing force. If the seal is sufficiently pliable to provide a moisture tight seal between the closure and container, the seal often does not provide a sufficiently large biasing force to ensure that young children are unable to effect the simultaneous depression and rotation of the cap so to remove it from the container, i.e., the closure is no longer child resistant.

Prior art has addressed the problem of providing a closure cap in which the sealing plug is sufficiently resilient to effect a moisture-tight seal, while ensuring a sufficient biasing force to maintain the closures child-resistant characteristics, by providing two-piece closures, such as those disclosed in U.S. Pat. Nos. 4,053,078 and 4,397,397. The closures shown in these two patents, which have been very successful commercially, employ a separate sealing fitment having a flange overlying the locking lugs on the outer cap and a deep plug that engages the interior cylindrical wall of the vial to form the vapor tight seal. The fitment also provided the spring force to hold the locking lugs within the locking members on the container. Such closures, however, suffer a competitive disadvantage due to the inherently greater expense for manufacturing and assembling two separate pieces, as opposed to a single-piece closure. The two-piece closure requires more molds to be tooled and an additional operation to assemble separate parts.

SUMMARY OF THE INVENTION

Accordingly, it is the primary object of the present invention to provide an improved one-piece closure that is both child resistant and capable of providing a proven moisture-tight seal with its associated container. Other objects and advantages will become apparent upon reference to the accompanying drawings and the detailed description that follows.

A safety closure meeting the above object is provided in a closure having an end wall with an annular depending skirt, the skirt having a plurality of locking lugs disposed on the inside thereof. The locking lugs cooperate with retaining notches adjacent to the open mouth of an associated container to releasably retain the closure on the container. A sealing plug integral with the end wall of the closure and concentric with the annular skirt effects a moisture-tight seal with the inner wall of the container. A plurality of resilient members or petals are integral with the interior of the closure and extend downwardly and inwardly so that they engage the end surface of the container opening. The flexure of the petals serves to bias the locking lugs on the closure into locking relationship with the retaining notches on the container with a force sufficient to ensure the child-resistant characteristics of the closure.

DETAILED DESCRIPTION

Figure 1:
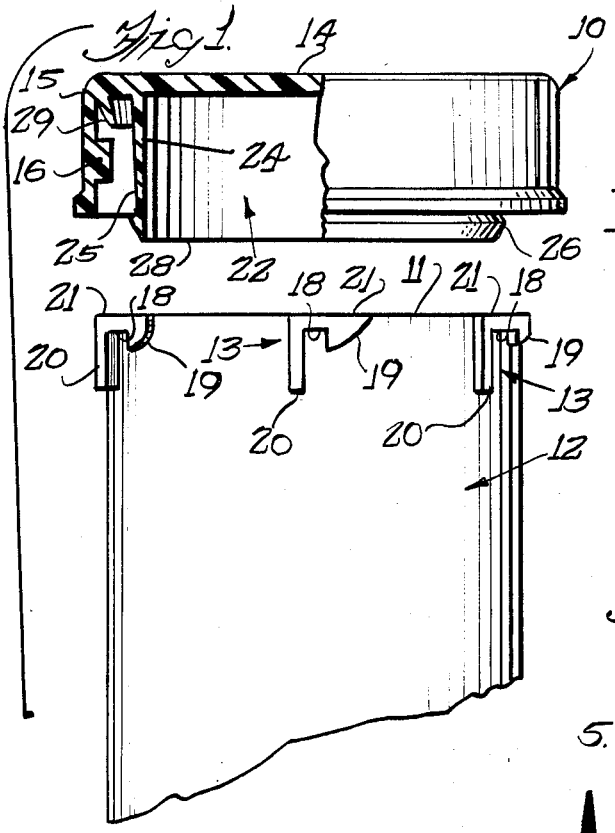
FIG. 1 is a partial elevational view, portions being shown in cross-section, of a safety closure and container in accordance with the present invention, the closure being spaced above the container.
Figure 2:
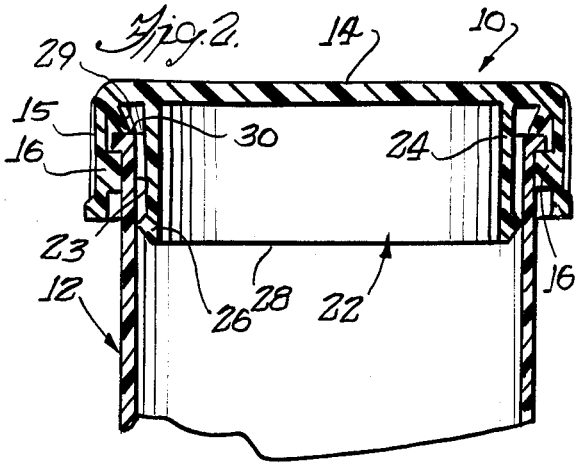
FIG. 2 is a partial longitudinal sectional view illustrating the safety closure of FIG. 1 mounted on the container.

Referring now to the drawings, a safety closure or cap constructed in accordance with the present invention is indicated generally by 10. The safety closure 10 is adapted to be applied in locking and sealing engagement onto the upper open mouth end, indicated generally at 11, of a container 12. The container 12 may be made of molded polypropylene or other suitable material which has good moisture barrier properties, while the closure 10 is preferably made of hi-density polyethylene plastic. The closure 10 has an upper planar top wall portion 14 and a depending annular skirt wall 15, the skirt wall 15 having a plurality of locking members in the form of locking lugs 16, of which there are six in the illustrated embodiment. (See FIG. 3.) The locking lugs 16 are formed on and project radially inwardly from the inner surface of the skirt wall 15 in circumferentially equidistantly spaced relation thereabout.

Figure 3:
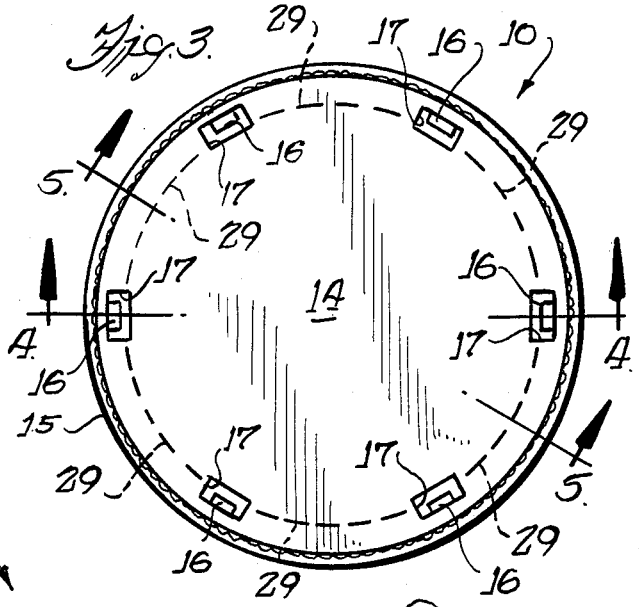
FIG. 3 is a top view of the inventive closure.
Figure 4:
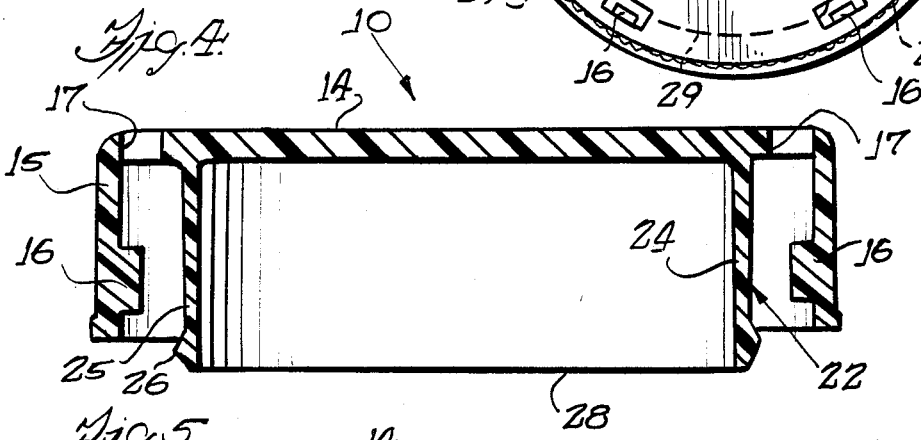
FIG. 4 is an enlarged cross-sectional view of the closure taken substantially along line 4—4 of FIG. 3 showing the locking lugs of the closure.
Figure 5:
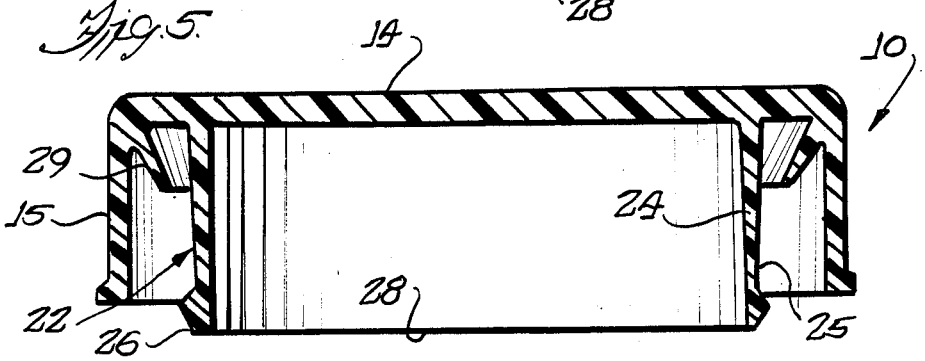
FIG. 5 is an enlarged cross-sectional view of the closure taken substantially along line 5—5 of FIG. 3 showing the resilient petals of the closure.

As seen in FIGS. 3 and 4, the closure top wall 14 contains a small rectangular hole 17 immediately above each of the locking lugs 16. The holes 17 are formed by mold members (not shown) that also form the upper surfaces of the locking lugs 16. After the closure 10 is molded, such mold members are withdrawn to permit the removal of the closure 10 from the mold.

The locking lugs 16 are spaced below the closure top wall 14 and are cooperable with complementary locking members 13 in the form of retaining notches 18 formed on the container 12 adjacent the upper open end 11 thereof, so as to releasably mount the closure 10 onto the container 12. As best seen in FIG. 1, each of the retaining notches 18 on the container 12 opens downwardly towards the bottom of the container and is defined by a cam wall 19 and a longitudinal stop wall 20. An upper bridge 21 defines the top of the retaining notches 18 and the retaining notches 18 project radially from the outer surface of the container 12 to define recesses for receiving the locking lugs 16 on the cap 10. In mounting the closure 10 on the container 12, the closure is rotated to a position in which the locking lugs 16 are between the locking members 13 on the container 12. The cap is then moved downwardly onto the container 12 and simultaneously rotated so that the locking lugs 16 seat within the downwardly opening retaining notches 18. To remove the closure 10 from the container 12, the closure is pressed downwardly and rotated in the opposite direction to unseat the locking lugs 16 from the retaining notches 18 and locate the locking lugs 16 in the spaces between the locking members 13. The closure 10 may then simply be lifted off the container 12. Typically, instructions for effecting closure and removal are embossed into the outer surface of the top wall 14 of the closure 10.

To provide a moisture-tight seal between the closure 10 and the container 12, the closure 10 is formed with a sealing plug, indicated generally at 22, having a sealing surface adapted for engagement with the internal wall of the container 12 at a distance axially downwardly from the upper open mouth end 11 of the container. As disclosed in U.S. Pat. No. 4,053,078, which is herein incorporated by reference, the sealing plug 22 comprises a downwardly depending annular wall 24 formed with its upper end integral with the lower surface of the top wall 14 of the closure 10. The annular wall 24 has a frustoconical outer peripheral surface 25 which terminates at its lower edge in a radially outwardly directed circumferential sealing bead 26 formed adjacent the lower annular edge surface 28 of the wall 24.

The container 12 may also be formed with an upwardly and outwardly tapered frustoconical lead-in surface 23 within the upper open neck end 11 of the container. Such a lead-in surface is particularly useful in applying the closure 10 to the container 12 when the sealing bead 26 has a diameter slightly less than the diameter of the top end of the lead-in surface. Hence the bead 26 need not be precisely centered to be fitted into the container 12. See the above-referenced U.S. Pat. No. 4,053,078. The sealing bead 26 is adapted to engage the interior surface of the container 12 at a location axially below the lower ends of the stop wall portions 20 of the retaining notches 18. Consequently, the container 12 is sealed below any possible recesses or indentations in the internal surface of the container wall that may be formed by differential cooling of the plastic container wall at the location of the retaining notches 18.

In accordance with the present invention, the sealing function obtained with the separable fitment of the prior art, as well as the spring biasing function provided by such a fitment, are now provided by a one-piece closure. This is achieved by making the plug integral with the upper cap wall 14 and providing a plurality of resilient spring members 29 formed integrally within the interior of the closure 10 so as to engage the rim of the container 12 to bias the locking lugs 16 into the retaining notches 18. Turning to the drawings, the preferred resilient members 29 are in the form of spring petals and are provided at the juncture of the top wall 14 and depending skirt wall 15. The spring petals 29 have a V-shaped cross-section and extend downwardly and inwardly from the top wall 14. In the preferred embodiment, the petals 29 form an angle of approximately 30° with respect to the skirt wall 15 of the closure 10 and extend downwardly a distance sufficient to engage the top edge 30 of the open mouth 11 of the container 12 before the locking lugs 16 are in a position to be received into the notches 18. Thus, the petals 29 must be compressed against the top edge or rim 30 of the container 12 and flexed or deflected upwardly and radially inwardly before the locking lugs 16 may be rotated into the retaining notches 18. When so located, the force exerted by the flexed spring petals 29 against the container 12 biases the locking lugs 16 upwardly against the bridges 21 that define the upper ends of the retaining notches 18. Herein, the flexed petals 29 provide a minimum of five pounds pressure and a maximum of fourteen pounds pressure in order to move the locking lugs 16 downwardly a distance sufficient to allow rotation of the closure cap 10 in a direction to release the locking lugs 16 from the retaining notches 18 for removal of the closure 10 from the container 12. Thus, the closure 10 will be child-resistent, yet not require excessive effort by adults to manipulate.

Because the resilient petals 29 are not required for sealing the container 12 (as was the case in the prior art), the petals 29 do not have to be sufficiently pliable to conform the top wall of the container so as to ensure sealing contact, but may be of a cross-section sufficiently large to ensure the desired compressive force to exert locking contact of the lugs 16 within the retaining notches 18. Further, because the sealing of the container 12 is by means of the plug bead 26 below any sinks which may form in the tapered lead-in surface opposite the locking members 13, a moisture tight seal of proven quality is assured.

In the formation of the locking lugs 16 and the cap 10, the mold members discussed above which extend through the upper cap wall 14 of the closure to form the holes 17 in the top wall 14 of the cap also create the gap between adjacent petals 29. Thus, as illustrated, the locking lugs 16 are equidistantly spaced about the depending skirt 15, and the resilient petals 29 are equidistantly spaced about the juncture of the skirt 15 and top wall 14, with the locking lugs 16 being axially aligned in the spaces between the resilient petals 29. For a cap 10 having an outside diameter of approximately 1½ inches, the six petals 29 each have a circumferential extent of approximately 48°, while each rectangular hole 17 has a circumferential extent of approximately 12°. In such a cap, each of the petals 29 has a cross-sectional length of approximately 1/6 inch, with the angle formed between each side of the petal (when viewed in cross-section) being approximately 6½°.

The biasing members or spring petals 29 may take various shapes and could be connected to the top wall of the closure or to the skirt wall of the closure, although in the preferred and illustrated construction, the petals 29 are located at the juncture of the top wall and skirt. By forming additional holes in the top wall with inserted molding pins forming the holes, the number of petals may be increased and the circumferential extent of a petal decreased. In another embodiment of the invention not illustrated herein, six small petals are provided below six small openings in the closure top in addition to the six openings above each of the six locking lugs.

While a preferred embodiment of the present invention has illustrated and described, it will be obvious to those skilled in the art that changes and modifications may be made without departing from the invention in its broader aspects. Various features of the invention are set forth in the following claims.

What is claimed is:

1. A child-resistant closure and container having a moisture-tight sealing engagement with each other comprising:

a container having a side wall, an upper end terminating in a rim with an open mouth over which said closure is received, with locking members on the outer side wall of said container defining areas of non-uniform cross-sectional thickness in the upper portion of said container; and a closure having a top wall adapted to extend across the mouth of said container with a depending skirt wall, a sealing plug extending downwardly from said top wall and having a depending wall for inserting into said open mouth of said container, said depending wall having an outwardly projecting annular sealing surface for effecting a sealing engagement with the inner side wall of said container, a plurality of locking lugs formed on the inner surface of said depending skirt wall for cooperation with the retaining notches on said container to selectively retain said closure on said container, and a plurality of resilient members integral with said closure disposed to engage the rim of said container so as to be compressed and flexed to bias the locking lugs on said closure into locking relationship with the retaining locking members on said container outer side wall until said closure is simultaneously forced downwardly and rotated relative to said container to release said closure.

2. A child-resistant closure and container in accordance with claim 1 in which the resilient members are formed at the juncture between the closure top wall and its skirt, the resilient members projecting radially downwardly and inwardly from the juncture and being flexed upwardly upon contact with the container rim.

3. A safety closure for use with a container having an open mouth defined by an annular neck wall having an annular end surface and a plurality of locking members formed on its outer surface adjacent said end surface, said safety closure comprising a closure cap having an end wall and an annular depending skirt, said skirt having a plurality of locking members internally thereon cooperable with said container locking members to releasably retain said cap on said container, a sealing plug integral with the end wall of said cap and concentric with said annular skirt, the sealing plug being adapted to effect a moisture-tight sealing relation with said container, and a plurality of resilient members integral with the interior of said cap and depending therefrom so as to engage the end surface of the neck wall, the resilient members being flexed and serving to bias the closure locking members into locking relation with the locking members on said container.

4. The combination of claim 3 wherein the closure locking members are equidistantly spaced about the depending skirt of the closure while the resilient members project downwardly and radially inwardly from the juncture of the depending skirt wall and top wall and are equidistantly spaced about the juncture.

5. The combination of claim 3 wherein there is an equal number of closure locking members and resilient members, the locking lugs being axially aligned with the spaces between the resilient members.

6. The combination of claim 4 wherein the number of container locking members and resilient members is six each.

7. The combination of claim 3 wherein the resilient members have a V-shaped cross-section and project radially inwardly and downwardly from the juncture of the skirt and the top wall at an angle of approximately 30° with respect to the skirt of the closure.

* * * * *